US005268696A

United States Patent [19]

Buck et al.

[11] Patent Number: 5,268,696

[45] Date of Patent: Dec. 7, 1993

[54] SLOTLINE REFLECTIVE PHASE SHIFTING ARRAY ELEMENT UTILIZING ELECTROSTATIC SWITCHES

[75] Inventors: Daniel C. Buck, Hanover; Steven Grice, Baltimore, both of Md.

[73] Assignee: Westinghouse Electric Corp., Pittsburgh, Pa.

[21] Appl. No.: 862,893

[22] Filed: Apr. 6, 1992

[51] Int. Cl.[5] ..... H01Q 3/22; H01Q 3/24; H01Q 3/26

[52] U.S. Cl. ..... 342/372; 343/768

[58] Field of Search ..... 342/6, 372; 343/700 MS, 343/768; 333/159, 139

[56] References Cited

U.S. PATENT DOCUMENTS 4,314,249 2/1982 Onoe .

4,922,253 5/1990 Nathanson et al. .

*Primary Examiner*—Theodore M. Blum

*Attorney, Agent, or Firm*—Thomas H. Martin

[57] ABSTRACT

An apparatus is disclosed for providing a radiating element having an electrical reflective phase shifter for reflecting electromagnetic energy received from an electromagnetic energy source including a dielectric substrate having a top surface, a conductive layer having a channel-like opening in its top surface and disposed on the top surface of the dielectric substrate, at least one electrostatic switch spans the channel-like opening and a means for selectively actuating the electrostatic switch to reflect the electrostatic energy. The electrostatically actuated mechanical switch utilizes a cantilever element fabricated by solid-state microfabrication techniques. The electrical reflective phase shifter can be grouped into a phase shifting reflect array for beam steering an electromagnetic energy from an electromagnetic energy source.

19 Claims, 3 Drawing Sheets

SLOTLINE REFLECTIVE PHASE SHIFTING ARRAY ELEMENT UTILIZING ELECTROSTATIC SWITCHES

BACKGROUND OF THE INVENTION

1. Field of the Invention

The present invention relates to phase shifters in general, and more particularly, to utilizing a means for shorting a slotline to vary the length of the slotline to a fraction of its predetermined length as measured from the open radiating end portion to the means for shorting to reflect electromagnetic energy, and more specifically, use a slotline spanned by selectively actuated electrostatic switches capable of reflecting electromagnetic energy when actuated into a closed position, thereby creating a slotline short for phase shifting.

2. Description of the Related Art

Electronically scanned phase shifting arrays have used semiconductors as the phase control elements. However, elements such as pin diodes, field effect transistors (FETs) or monolithic microwave integrated circuits (MMICs) consume undesirable amounts of power as antenna frequencies are increased. Phase shifting reflect arrays have previously been done with ferrites which are slow, have higher loss, and have high driver power consumption, as well as require integration with the antenna. The requirement for antenna integration results in increased cost to the overall system.

Changes in integrated circuits have been possible due to recent developments in microfabrication techniques. These changes have been addressed to making the devices smaller, more efficient, and capable of large scale production at low cost. More specifically, micromachining includes the techniques of planar technology, wet chemical etching and other etching techniques, metallization, and metal deposition.

The present inventive concept is a phase shifter which includes a basic electrostatically actuated cantilever switch spanning a slotline for use in reflecting electromagnetic energy. However, from a more basic perspective, the present invention is the utilization of a means for shorting a slotline to varying lengths of its initial predetermined length for phase shifting electromagnetic energy. This type of phase shifter is smaller, less expensive, lower loss, faster and requires less control power consumption than phase control elements used in the prior art. A series of these slotline arrangements create a phase shifter subarray which can be utilized for beam steering.

CROSS REFERENCE TO RELATED PATENTS & APPLICATIONS

U.S. Pat. No. 4,205,282 to Gipprich, issued May 27, 1980, entitled "Phase Shifting Circuit Element," and assigned to the assignee of the present invention, describes an electrical phase shifting circuit element of the reflective type including a switching element which is preferably a pin diode. This device is an example of the prior art which utilizes semiconductors as the phase control elements.

U.S. Patent application Ser. No. 07/780,690 to Buck, filed Oct. 18, 1991, entitled "Low Inductance Cantilever Switch," and assigned to the assignee of the present invention, describes a microstrip stripline switch capable of actuation with reduced voltage requirements and lower switch impedance. This type of electrostatic cantilever switch is utilized in the preferred embodiment of the present invention in conjunction with a slotline for use as a phase shifter.

As can be seen in the above referenced art, it is known in the prior art to fabricate compression bonded microelectronic switches. However, the use of these switches for phase shifting applications results in a less expensive, lower power consumption, faster device than previously disclosed by the prior art.

SUMMARY OF THE INVENTION

Accordingly, it is an object of the present invention to provide a radiating element having an electrical reflective phase shifter which utilizes electrostatic switch technology for a low power loss, low cost and a low DC bias switch device.

It is another object of the present invention to provide a phase shifting array for beam steering which requires no assembly.

A further object of the present invention is to provide a phase shifter which is small and lightweight.

Additional objects and advantages of the invention will be set forth in the description which follows, and in part will be apparent from the description, or may be learned by practice of the invention. The objects and advantages of the invention may be realized and obtained by means of the methods, instrumentalities and combinations particularly pointed out in the appended claims.

To achieve the foregoing objects, and in accordance with the purposes of the invention as embodied and broadly described herein, an appropriately designed radiating element may be used for phase shifting electromagnetic energy received from an electromagnetic energy source through the use of electrostatic switches placed across the radiating element's channel-like opening. The channel-like opening or slotline has an open end and a closed end. The closed end is referred to as a slotline short. The principle behind the present invention is that a signal received by the radiating element will propagate through the channel-like opening, reflect off the slotline short and return out of the radiating element. When an electrostatic switch is actuated into the closed position, the slotline short is effectively moved to the location of the closed switch. The result is a reduction in the two way distance of the slotline, creating a phase shift.

However, the principle behind the present invention is not limited to the use of the electrostatic switch for shorting the slotline. Any means for shorting the slotline to varying lengths of its initial predetermined length as measured from the open radiating end portion to the means for shorting to reflect the electromagnetic energy, which can be used in conjunction with a means for selectively actuating the means for shorting, is claimed as part of the present invention.

In accordance with the present invention, a radiating element having an electrical reflective phase shifter for directing an electromagnetic energy from an electromagnetic energy source received by the radiating element comprises a dielectric substrate, a conductive layer, at least one electrostatic switch and a means for selectively actuating the switch. The conductive layer which is disposed on the top surface of the dielectric substrate has a top surface with a channel-like opening formed therein. The channel-like opening has an open radiating end portion and a closed reflective end portion. The electrostatic switch is disposed on the conductive layer and the dielectric substrate so that at least a portion of the electrostatic switch spans the channel-like opening. The radiating element includes a means for selectively actuating the electrostatic switch to reflect the electromagnetic energy.

In another aspect of the invention, an antenna having an electrical reflective phase shifting array for beam steering electromagnetic energy from an electromagnetic energy source received by the antenna comprises a dielectric substrate, a conductive layer, at least one electrostatic switch, and a means for actuating the electrostatic switch. The arrangement is essentially the same as that laid out in the preceding paragraph except that the conductive layer has a plurality of channel-like openings formed in the top surface. A means for selectively actuating each electrostatic switch is used for beam steering the reflected electromagnetic energy.

The disclosed embodiments of the present invention address the need for substantially reducing the cost associated with radar having precision object location capability. At least one electrostatic switch spanning a slotline is used for the phase shifting element. The phase shifting element reflects a signal received from a source of electromagnetic energy. A plurality of phase shifting elements may form a phase shifting reflect array.

BRIEF DESCRIPTION OF THE DRAWINGS

The accompanying drawings, which are incorporated in and constitute a part of the specification, illustrate a presently preferred embodiment of the invention which, taken with the general description of the preferred embodiment given below, serve to explain the principles of the invention. Throughout the drawings, like reference numerals depict like elements. In the drawings.

DETAILED DESCRIPTION OF THE PREFERRED EMBODIMENTS

Figure 1:
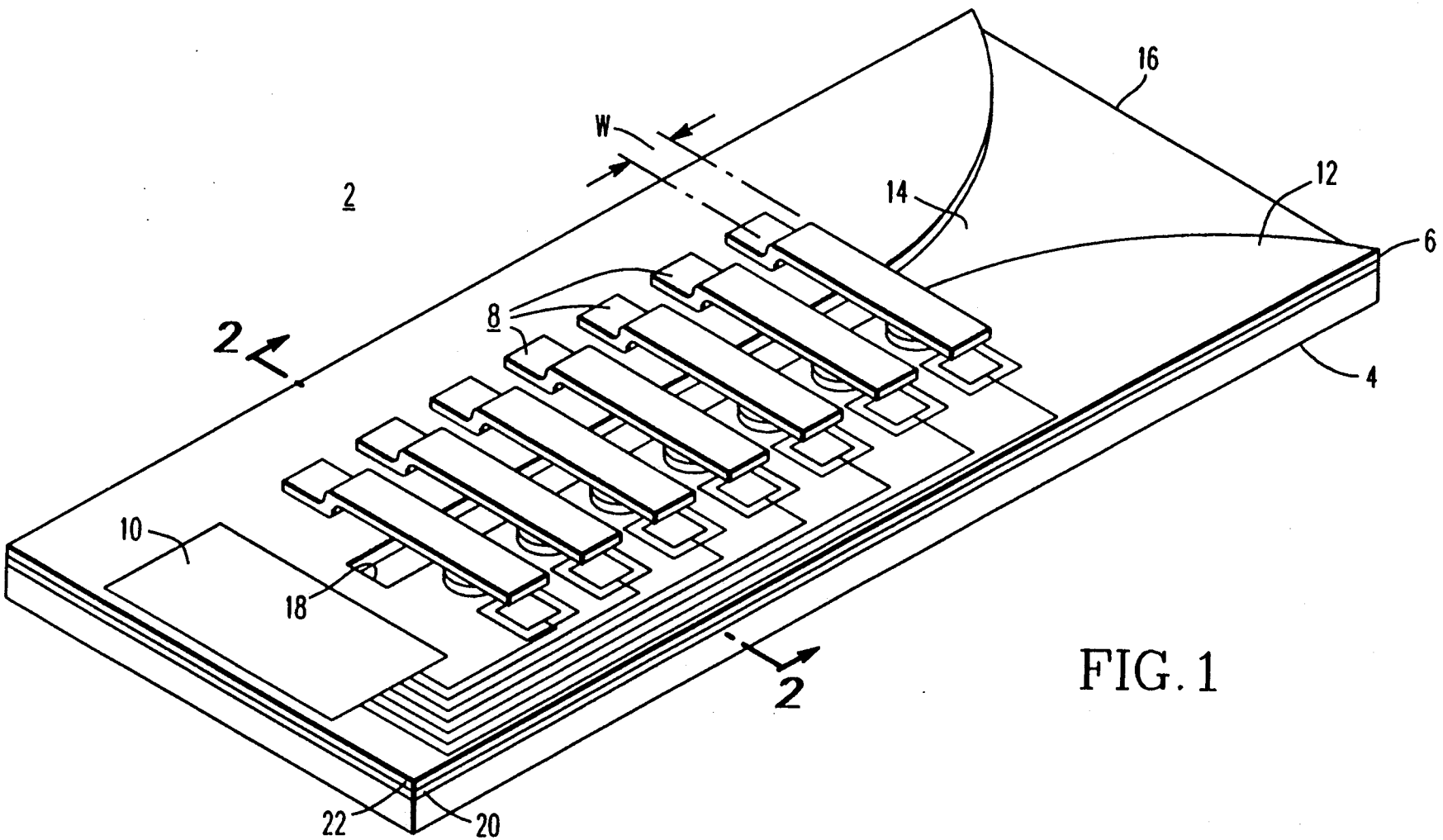
FIG. 1 is a perspective view of a radiating element which embodies the present invention.

A radiating element 2 having an electrical reflective phase shifter for directing electromagnetic energy received from an electromagnetic energy source which embodies the principles and concepts of the present invention is illustrated in FIG. 1. The radiating element 2 includes a dielectric substrate 4, a conductive layer 6, a means for shorting the slotline 8 and a means for selectively actuating 10 the means for shorting 8. The conductive layer 6 having a top surface 12 is attached to the top surface of the dielectric substrate 4. The top surface 12 of the conductive layer 6 has a channel-like opening or slotline 14 having a preselected length formed therein. The channel 14 has an open radiating end portion or input port 16 at one end and a slotline short 18 at an opposite end. Means for shorting the slotline 8 are positioned on the conductive layer 6 so that at least a portion of the means for shorting 8 spans the slotline 14. The means for shorting 8 are used to vary the length of the slotline 14 to a fraction of the preselected length of the slotline 14 as measured from the open radiating end portion 16 to the means for shorting 8 to reflect the electromagnetic energy. The radiating element 2 additionally includes means for selectively actuating 10 the means for shorting 8.

A more specific characterization of a preferred embodiment, as illustrated in FIG. 1, is a radiating element 2 having an electrical reflective phase shifter for directing electromagnetic energy from an electromagnetic energy source received by the radiating element. The radiating element 2 includes a dielectric substrate 4, a conductive layer 6, at least one electrostatic switch 8 and a means for selectively actuating 10 the switch 8. The conductive layer 6 having a top surface 12 is disposed on the top surface of the dielectric substrate 4. The top surface 12 of the conductive layer 6 has a channel-like opening or slotline 14 formed therein. The channel-like opening 14 has an open radiating end portion or input port 16 at one end and a closed reflective end portion or slotline short 18 at an opposite end. At least one electrostatic switch 8 is disposed atop the conductive layer 6 and the dielectric substrate 4 so that at least a portion of the electrostatic switch 8 spans said channel 14. The radiating element 2 additionally includes means for selectively actuating 10 the electrostatic switch 8 to reflect the electromagnetic energy.

The principle utilized in the present invention is that electromagnetic energy received by the radiating element 2 will propagate down through the slotline 14 when the switches 8 are open, reflect off the slotline short 18 and return out of the radiating element 2. When an electrostatic switch 8 is actuated into the closed position, the slotline short 18 is effectively moved to the location of the closed switch. A phase shift results due to the reduction in the two way distance of the slotline 14.

A suitable structural embodiment of the disclosed radiating element 2 includes the conductive layer 6 comprised of two separate layers. A first layer 20 of titanium disposed on the dielectric substrate 4 and a second layer 22 of gold disposed on the first layer 20. Preferred thicknesses found suitable for the purposes of this embodiment are approximately 300 angstroms titanium and 1.5 microns of gold.

Figure 2:
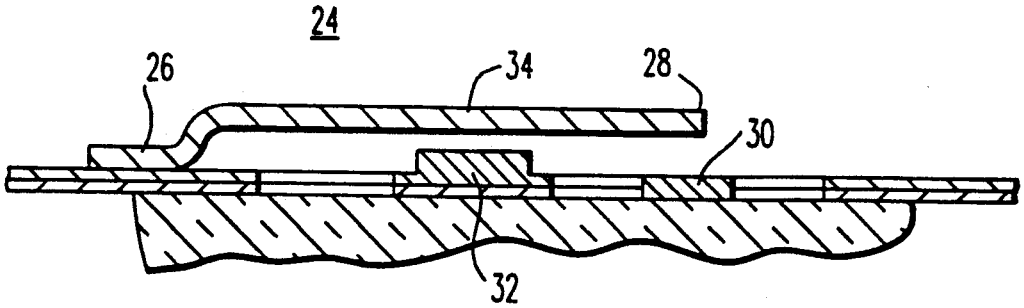
FIG. 2 is a cross-sectional view of the electrostatic switch spanning the slotline taken along line 2—2 of FIG. 1.

FIG. 2 shows a cross-section view taken along 2—2 of FIG. 1. It shows an electrostatic switch 8 spanning the slotline 14. A cantilever element 24 is secured to the top surface 12 of the conductive layer 6 at a first end portion 26 and free to move at the opposite second end portion 28. Under the free second end portion 28 of the cantilever element 24, and connected to the dielectric substrate 4, is a pull down electrode 30. Additionally, under the free second end portion 28 of the cantilever element 24, and mounted to the top surface 12 of the conductive layer 6, is a contact pad 32 which is located between the attached first end portion 26 of the cantilever element 24 and the pull down electrode 30. The contact pad 32 is closer than the pull down electrode 30 to the cantilever element 24. Electrical contact is made with the fixed first end portion 26 of the cantilever element 24 and with the pull down electrode 30, resulting in an electrostatic charge being selectively applied to the two elements by a means for selectively actuating 10 the electrostatic switch 8. The free second end portion 28 of the cantilever element 24 and the pull down electrode 30 are drawn towards one another by the electrostatic force of the charge applied to the two elements. The pull down electrode 30 is attached to the dielectric substrate 4 and the free second end portion 28 of the cantilever element 24 is free to move, thus only the cantilever 24 free second end portion 28 is deflected towards the pull down electrode 30. The cantilever element 24 deflects until it contacts the contact pad 32. The cantilever element 24 does not come into contact with the pull down electrode 30. While the electrostatic switch configuration disclosed is that of an improved switch set forth in the heretofore stated U.S. patent application Ser. No. 07/780,690, it is understood that the present invention may be configured with other electrostatic switches previously known in the art.

The coupling and decoupling of the cantilever element 24 and the contact pad 32 is accomplished by means for selectively actuating 10 an electrostatic charge to the first end portion 26 of the cantilever element 24 and with the pull down electrode 30. The means for selectively actuating 10 the electrostatic switch 8 by providing the electrostatic charge between the cantilever element 24 and the pull down electrode 30 may be a control and logic device or any DC power supply 30.

Additionally, in one embodiment the cantilever element 24 includes a center portion 34 extending between the first 26 and second end portions 28. Under the center portion 34 of the cantilever element 24, and attached to the conductive layer 6, is a contact pad 32 which is located between the attached first end portion 26 of the cantilever element 24 and the pull down electrode 30. The contact pad 32 is positioned to contact the cantilever element 24 as the cantilever element 24 deflects towards the pull down electrode 30. The center 34 and second end portion 28 of the cantilever element 24 is positioned a predetermined distance from the contact pad 32 and pull down electrode 30 respectively, with the distance between the center portion 34 and contact pad 32 being less than that between the second end portion 28 and the pull down electrode.

For the electrostatically actuated cantilever switch 8 shown in FIGS. 1 and 2, the values of an exemplary switch 8 may have the following approximate values:

g=5 microns
l=4 mils
w=20 microns
t=1 microns

Figure 3:
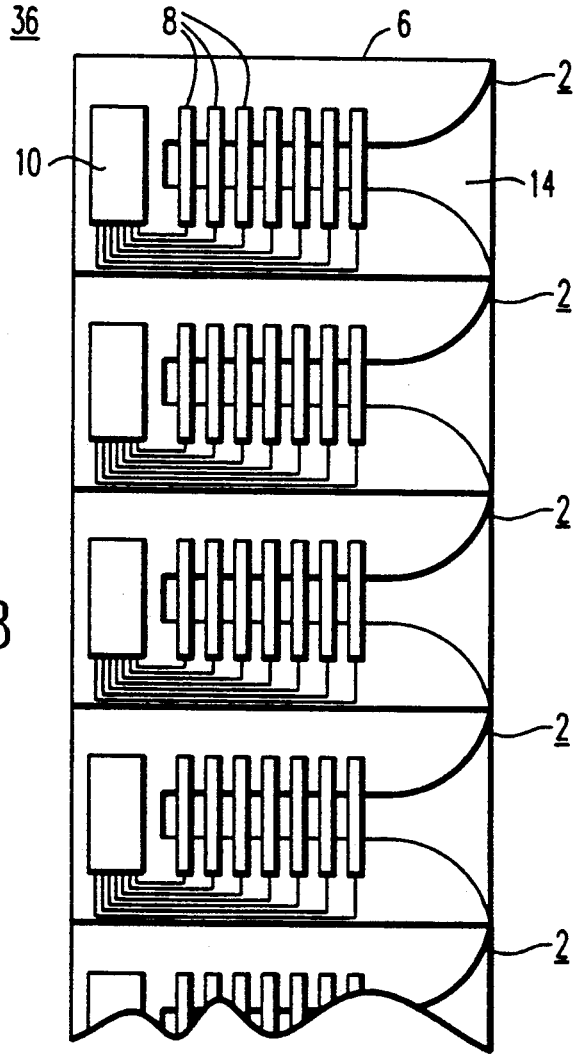
FIG. 3 is a top oriented schematic view of a phase shifting subarray comprising a plurality of radiating elements used for beam steering electromagnetic energy.

In FIG. 3 an antenna having an electrical reflective phase shifting array 36 for beam steering electromagnetic energy from an electromagnetic energy source received by the antenna including the equivalent of a plurality of radiating elements 2 as described above is illustrated. In other words, the conductive layer 6 has a plurality of channel-like openings 14 formed therein and the means for selectively actuating 10 each electrostatic switch 8 is used for beam steering the electromagnetic energy.

The radiating element having an electrical reflective phase shifter of the present invention takes the form of a slotline in a conductive layer spanned by at least one electrostatically actuated mechanical switch fabricated by solid-state microfabrication techniques. The principle behind the present invention is that a signal received by the radiating element will propagate through the slotline, reflect off the slotline short and return out of the radiating element. When an electrostatic switch spanning the slotline is closed, the slotline short is effectively moved to the location of the closed switch, thus the two-way distance is reduced, changing the phase.

If there are no switches or only open switches spanning the slotline, the electromagnetic energy propagates down the slotline to its end and then reflects back. This results in a phase of 2*theta. If a selected switch is in the closed position, assuming it is a perfect switch, then the electromagnetic energy will pass by any open switches closer to the slotline open end portion and reflect back upon encountering the closed switch. The phase may then be calculated.

A plurality of switches may be used to divide the slotline into a number of gaps according to the phase shifting requirements of the intended device. For example, seven switches may be used to create eight different possible slotline short positions or the equivalent of one eighth theta for each gap. Of course, more switches allow more incremental phase shifting adjustments.

Whether the electrostatic switch is open or closed, it has the same DC potential as the conductive layer and contact pad. However, the electrostatic switch has a different RF potential in the closed rather than in the open position. In the open position, the switch has a different RF potential than the slotline, while in the closed position the RF potential is the same as that of the slotline short, effectively creating a new slotline short at the closed switch.

The relative phases are given by 2*[(delta line length)*(radian frequency)/(slotline phase velocity)].

$$\phi i - \phi j = 2(l_i - l_j)2\pi F/V_{PSL}$$

The impedance looking into the slotline short past the closed electrostatic switch is given by:

$$Z_{short} = \frac{jwLZoT}{(wL + ZoT)}$$

where T=tan (2π*length/wavelength) and Zo is the slotline characteristic impedance. If inductance L is small, then the net impedance is dominated by the electrostatic switch except for the special case of the length being a quarterwave. Under this special case, T=0 and the denominator is large making the combined impedance close to a short. Low dispersion phase shift is possible because the shunt inductance is sufficiently low and the slotline dimensions which meet the Zo desired are low loss. The reflection coefficient at the electrostatic switch is given by;

$$Rho = (jwL - Zo - wL/T) / (jwL + Zo - wL/T)$$

For L=0, Rho=1 which is the value for a short which is completely reflective. The return loss is tabulated verses inductance i.e. switch length in Table 1. The cantilever arm is on the order of 20 microns wide, and 1 micron thick. Given these dimensions for a 100 ohm transmission line as an example, the inductance L is given by:

$$L = \frac{Zol}{V} \ (nH)$$

where l: switch cantilever length in cm
v: $30 \times 10^9$ cm/sec
and the return loss is given by:

$$RtnLoss(dB) = 20 \log \left| \frac{(jwl/Zo) - 1}{(jwl/Zo) + 1} \right|$$

TABLE 1

| Switch Length vs. Return Loss (dB) | |
|---|---|
| Length of electrostatic switch (mils) | Rtn Loss (dB) |
| 4 | .036 |
| 8 | .073 |
| 16 | .150 |

For a return loss of 0.036 dB, and 35 GHz, less than 1 degree of phase error with respect to an ideal short will occur.

The open capacitance can be calculated as follows:

$$c = 8.854 \times 10^{-12} F/m * Area/Distance$$

The distance between the contact pad and the cantilever arm is typically 5 microns, with the area being $20 \times 20$ microns. The capacitance is determined to be $< 10^{-3}$ pF. The impedance generated in shunt with the transmission line is over $10^4$ larger than the 100 ohm slotline characteristic impedance, so the open switch does not load the slotline.

With the principles derived from the above teachings, one may assemble a plurality of radiating elements into an electrical phase shifting array for use in an antenna for beam steering electromagnetic energy received by the radiating element from an electromagnetic energy source. The phase shifting array beam steers by having the means for selectively actuating various electrostatic switches in the radiating elements cause varying phase shifts to occur in side by side radiating elements. For example, a first radiating element may have the electrostatic switch closest to the open end portion of the channel closed; the adjacent radiating element may have the next closest switch to the open end of the channel closed; and so on until no more switches are available in the sequence for closing and the slotline short is used in the last radiating element of the phase shifting array. The beam is steered in a direction calculated through the use of vector analysis.

Figure 4:
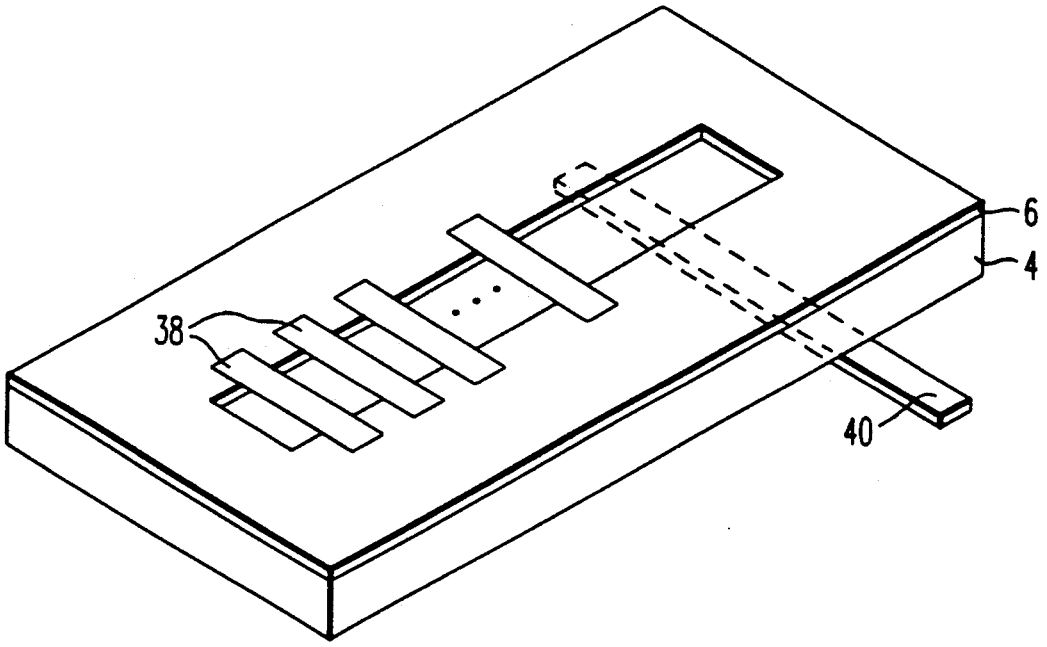
FIG. 4 is a perspective view of an experimental device used in proving the basic concepts and principles of the present invention.

Initial testing, as depicted in FIG. 4, proves that the slotline electrostatic switch can function according to the principles and concepts of the present disclosed invention. The tested configuration used a dielectric substrate 4, a conductive layer of copper 6 attached to the substrate 4, and copper foil strips 38 substituted for electrostatic switches attached to the conductive layer 6. A microstrip coupler 40 was attached to the bottom of the substrate 4. The foil strips 38 were removed in sequential order with return loss, magnitude and phase, being measured. As expected, phase shift verses line length was linear. Magnitude of the return loss remained constant. The validity behind the concept of the present invention to change phase by shorting the slotline was proven by this test.

Thus, it is intended by the following claims to cover all such modifications and adaptations which fall within the true spirit and scope of the invention.

What is claimed is:

1. A radiating element having an electrical reflective phase shifter for directing electromagnetic energy received from an electromagnetic energy source comprising:

(a) a dielectric substrate having a top surface;

(b) a conductive layer disposed on said top surface of said dielectric substrate, said conductive layer having a top surface and a slotline having a preselected length formed therein, said slotline having an open radiating end portion;

(c) means for shorting said slotline to vary said length of said slotline to a fraction of said preselected length of said slotline as measured from said open radiating end portion to said means for shorting to reflect said electromagnetic energy; and (d) means for selectively actuating said means for shorting.

2. A radiating element as recited in claim 1, wherein said means for shorting includes placing a conductive member across said slotline.

3. A radiating element as recited in claim 1, wherein said means for shorting is an electrostatic switch disposed atop said conductive layer and said dielectric substrate.

4. A radiating element having an electrical reflective phase shifter for directing electromagnetic energy from an electromagnetic energy source received by the radiating element comprising:

(a) a dielectric substrate having a top surface;

(b) a conductive layer disposed on said top surface of said dielectric substrate, said conductive layer having a top surface and a slotline formed therein, said slotline having an open radiating end portion and a closed reflective end portion;

(c) at least one electrostatic switch disposed atop said conductive layer and said dielectric substrate so that at least a portion of said electrostatic switch spans said slotline; and (d) means for selectively actuating said electrostatic switch to reflect said electromagnetic energy.

5. A radiating element as recited in claim 4, wherein said conductive layer further comprises:

(a) a first layer consisting titanium disposed on said dielectric substrate; and (b) a second layer consisting gold disposed on said first layer.

6. A radiating element as recited in claim 5, wherein said first layer is approximately 300 angstroms.

7. A radiating element as recited in claim 5, wherein said second layer is approximately 1.5 microns.

8. A radiating element having an electrical reflective phase shifter as recited in claim 4, wherein said electrostatic switch comprises:

(a) a pull down electrode connected to said dielectric substrate;

(b) a cantilever element having a first end portion secured to said top surface of said conductive layer, an opposite second end portion positioned in spaced relation to said pull down electrode and operable in response to an electrostatic charge established between said cantilever element and said pull down electrode to deflect in a direction towards said pull down electrode; and (c) a contact pad mounted on said top surface of said conductive layer between said cantilever element first end portion and said pull down electrode and positioned to contact said cantilever element as said cantilever element deflects towards said pull down electrode.

9. A radiating element having an electrostatic switch as recited in claim 8, wherein said cantilever element includes a center portion extending between said first and second end portions and operable to contact said contact pad as said cantilever element deflects towards said pull down electrode.

10. A radiating element having an electrostatic switch as recited in claim 8, wherein:

(a) said center portion of said cantilever element is positioned a predetermined distance from said contact pad;

(b) said second end portion of said cantilever element is positioned a predetermined distance from said pull down electrode; and (c) said predetermined distance between said center portion of said cantilever element and said contact pad is less than said predetermined distance between said second end portion of said cantilever element and said pull down electrode.

11. A radiating element having an electrostatic switch as recited in claim 10, wherein the predetermined distance between said cantilever element and said contact pad is approximately 5 microns.

12. A radiating element having an electrostatic switch as recited in claim 8, wherein said cantilever element has a length of approximately 4 mils.

13. A radiating element having an electrostatic switch as recited in claim 8, wherein said cantilever element width is approximately 5 microns.

14. A radiating element having an electrostatic switch as recited in claim 8, wherein said cantilever element is approximately 1 micron in thickness.

15. An antenna having an electrical reflective phase shifting array for beam steering electromagnetic energy from an electromagnetic energy source received by the antenna comprising:

(a) a dielectric substrate having a top surface;

(b) a conductive layer disposed on said top surface of said dielectric substrate, said conductive layer having a top surface and a plurality of slotline formed therein, said slotline having an open radiating end portion and a closed reflective end portion;

(c) at least one electrostatic switch disposed atop said conductive layer and said dielectric substrate so that at least a portion of said electrostatic switch spans each slotline; and (d) means for selectively actuating each electrostatic switch for beam steering said electromagnetic energy.

16. A antenna having an electrical reflective phase shifting array as recited in claim 15, wherein said electrostatic switch comprises;

(a) a pull down electrode connected to said top surface of said dielectric substrate;

(b) a contact pad mounted on said top surface of said conductive layer; and (d) a cantilever element having a first end portion affixed to the conductive layer, an opposite second end portion extending over but spaced from said pull down electrode, and a center portion extending between said first and second end portions positioned over but spaced from said contact pad.

17. A antenna having an electrical reflective phase shifting array as recited in claim 16, wherein said means for selectively actuating each electrostatic switch comprises establishing an electrostatic charge attraction between said cantilever element and said pull down electrode;

whereby said end portion of said cantilever element may be deflected towards said pull down electrode by establishing an electrostatic charge between said cantilever element and said pull down electrode;

whereby said cantilever element contacts said contact pad.

18. An antenna as recited in claim 16, wherein the gap between said contact pad and said cantilever element is less than the gap between said pull down electrode and said cantilever element.

19. A radiating element having an electrical reflective phase shifter for reflecting electromagnetic energy from an electromagnetic source received by the radiating element comprising:

(a) a dielectric substrate having a top surface;

(b) an conductive layer disposed on said top surface of said dielectric substrate, said conductive layer having a top surface;

(c) at least one slotline in said conductive layer, each slotline having an input port at one end for receiving an electrical RF signal, a slotline short at an opposite end, a first side and an opposite second side between said one end and said opposite end;

(d) a pull down electrode connected to said top surface of said dielectric substrate on said first side of each slotline;

(e) at least one cantilever element having a first end portion secured to said top surface of said conductive layer on said second side of said slotline, an opposite end portion positioned in spaced relation to said pull down electrode and operable in response to an electrostatic charge established between said cantilever element and said pull down electrode to deflect in a direction towards said pull down electrode; and (f) a contact pad mounted on said top surface of said conductive layer between said cantilever element first end portion and said pull down electrode and positioned to contact said cantilever element as said cantilever element deflects towards said pull down electrode;

whereby, said cantilever element acts as a slotline short upon making contact with said contact pad by reflecting the electromagnetic energy from an electromagnetic energy source.

* * * * *